US005526855A

United States Patent [19]

Graham

[11] Patent Number: 5,526,855

[45] Date of Patent: Jun. 18, 1996

[54] LOG SPLITTER AND DETACHABLE TABLE

[76] Inventor: Donald M. Graham, HC 75 Box 47; So. Hwy. 84, Chama, N.M. 87520

[21] Appl. No.: 512,370

[22] Filed: Aug. 8, 1995

[51] Int. Cl.[6] ..... B27L 7/00

[52] U.S. Cl. ..... 144/195.1; 108/12; 108/19; 108/157; 144/366; 144/193.1; 248/339

[58] Field of Search ..... 108/18, 19, 12, 108/65, 144, 156, 157; 248/676, 677, 678, 317, 339; 144/193 R, 193 A, 366

[56] References Cited

U.S. PATENT DOCUMENTS

| | | | |
|---|---|---|---|
| 3,319,675 | 5/1967 | Bles | 144/193 |
| 3,938,567 | 2/1976 | Dircksen | 144/193 A |
| 3,974,867 | 8/1976 | Butas, Jr. | 144/193 A |
| 4,239,070 | 12/1980 | Burns | 144/193 A |
| 4,431,362 | 2/1984 | Wech, Jr. et al. | 144/193 A |
| 4,487,239 | 12/1984 | Anderson | 144/193 A |
| 4,544,008 | 10/1985 | Reini | 144/193 A |
| 4,842,030 | 6/1989 | Meyer | 144/193 A |
| 4,951,726 | 8/1990 | Sieverin | 144/193 A |

*Primary Examiner*—W. Donald Bray
*Attorney, Agent, or Firm*—Cahill, Sutton & Thomas

[57] ABSTRACT

A log splitter having an elongated frame includes a detachable table including a platform, a clamp for attaching the platform to the frame, and an adjustable leg pivotally attached to the underside of the platform. The clamp includes at least one catch attached to the platform for engaging one side of the frame and a hook for engaging the opposite side of the frame. A strap connects the hook to the platform and is adjustable in length to accommodate frames of different widths.

5 Claims, 1 Drawing Sheet

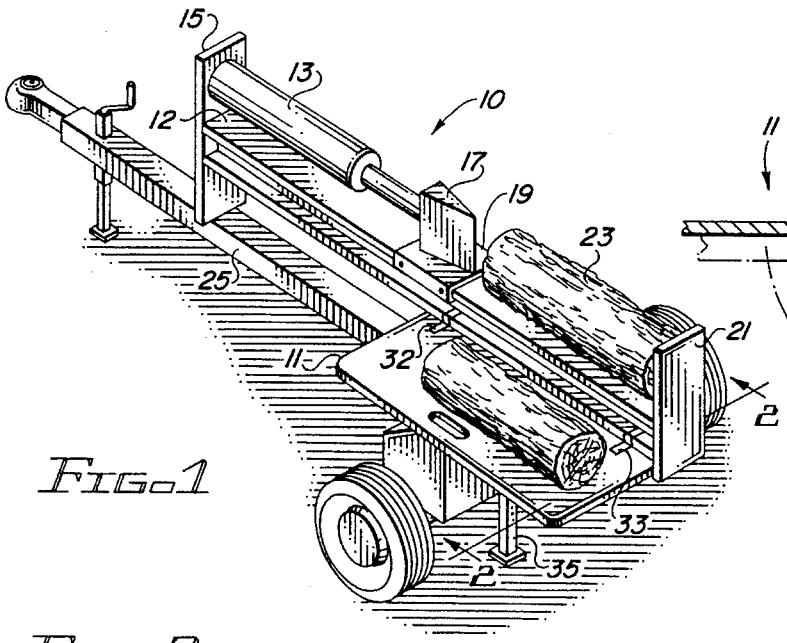
FIG. 1
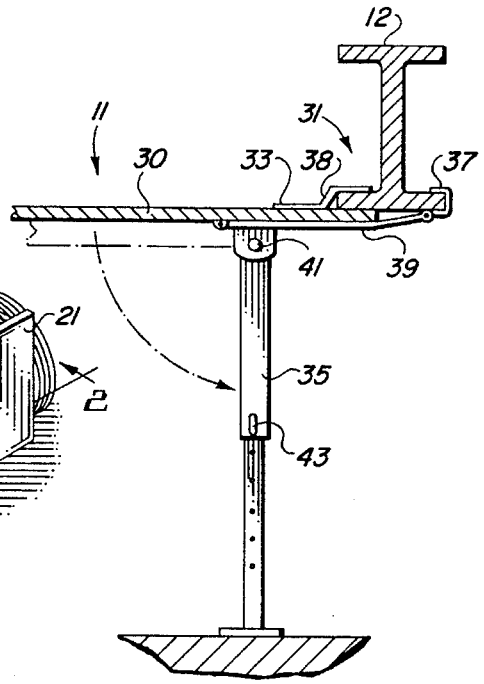
FIG. 2
FIG. 3
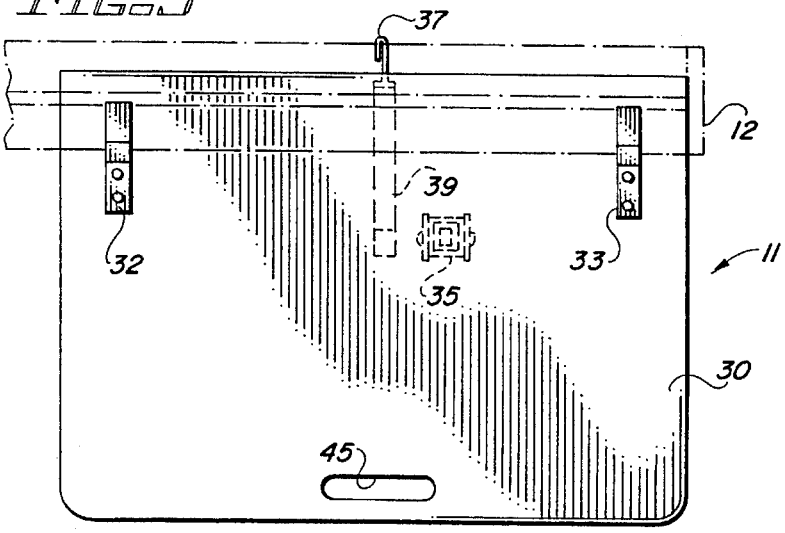
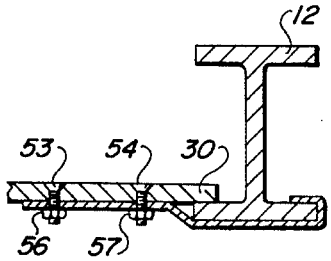
FIG. 5
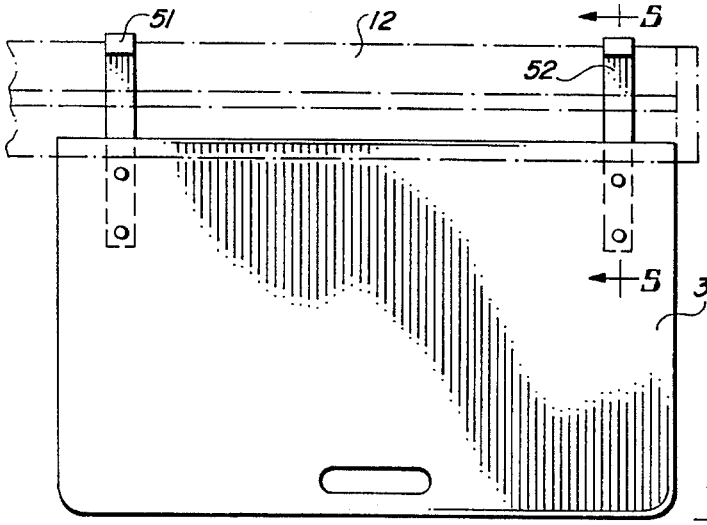
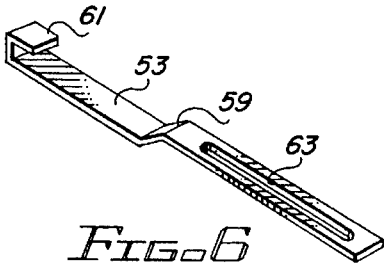
FIG. 6
FIG. 4

LOG SPLITTER AND DETACHABLE TABLE

BACKGROUND OF THE INVENTION

This invention relates to a log splitter and, in particular, to a portable log splitter having a table that can be securely attached to the splitter and easily removed from the splitter.

Portable log splitters fill the gap between sawmills and individuals armed with an ax or with a froe and a maul. Much useful wood can be gathered from wooded areas that cannot be de-forested or are uneconomical to harvest commercially. A log splitter enables one to reduce pieces of gathered wood to a manageable size for fire wood or to provide carefully chosen starting material for a woodworking project.

Harvesting fallen trees or limbs is a lot of work, even with a log splitter. A log splitter typically includes a support beam, such as a steel I-beam, having a stop at one end and a hydraulically actuated ram at the other end. A log is inserted between the ram and the stop and a wedge on the ram is forced into the log, splitting the log. The process is repeated as necessary until the pieces are reduced to the desired size. If the split pieces fall to the ground, the work is even more repetitious as the pieces are picked up several times for re-splitting.

Several commercially available, portable log splitters do not provide a mechanism for catching the split pieces, although permanently attached trays and other devices are known in the art. For example, U.S. Pat. No. 3,319,675 (Bles) discloses a log splitter including flanges on a tubular beam for receiving a split log. U.S. Pat. No. 4,239,070 (Burns) discloses a log splitter including catch trays welded to an H-beam. Each tray is supported by a brace running from the outside edge of the tray to the underside of the H-beam. U.S. Pat. No. 4,487,239 (Anderson) discloses a log splitter including an I-beam and pair of tables on either side of the I-beam for receiving the split log. The table is supported by a brace connected between the table and the lower portion of the I-beam. U.S. Pat. No. 4,842,030 (Meyer) discloses a log splitter including an I-beam and a table extending to one side of the I-beam. The table is raised and lowered by a pneumatic cylinder interconnecting the table and the I-beam.

Detachable tables are not commercially available, perhaps because it is difficult to provide a table that is sufficiently rugged and yet easily attached and removed. Further, a table must be able to fit the several commercially available log splitters.

In view of the foregoing, it is therefore an object of the invention to provide a rugged table that can be attached to a commercially available log splitter and removed for transporting the log splitter from site to site.

Another object of the invention is to provide a removable table for a log splitter that is as rugged as a table permanently attached to a log splitter.

A further object of the invention is to provide a table for a log splitter that can easily be attached and removed.

Another object of the invention is to provide a removable table for a log splitter that can be attached to log splitters from several different manufacturers.

SUMMARY OF THE INVENTION

The foregoing objects are achieved in the invention in which a log splitter having an elongated frame includes a detachable table including a platform, a clamp for attaching the platform to the frame, and an adjustable leg pivotally attached to the underside of the platform. The clamp includes at least one catch attached to the platform for engaging one side of the frame and a hook for engaging the opposite side of the frame. A strap connects the hook to the platform and is adjustable in length to accommodate frames of different widths.

BRIEF DESCRIPTION OF THE DRAWINGS

A more complete understanding of the invention can be obtained by considering the following detailed description in conjunction with the accompanying drawings, in which:

FIG. 1 illustrates a portable log splitter and a detachable table constructed in accordance with a preferred embodiment of the invention;

FIG. 2 illustrates a cross-section of the log splitter and table taken along line 2—2 in FIG. 1;

FIG. 3 is a top view of a table constructed in accordance with a preferred embodiment of the invention;

FIG. 4 is a top view of a table constructed in accordance with an alternative embodiment of the invention;

FIG. 5 is a cross-section of the attachment mechanism taken along line 5—5 in FIG. 4; and FIG. 6 is a perspective view of a hardware component for attaching the table shown in FIG. 4 to a splitter.

DETAILED DESCRIPTION OF THE INVENTION

FIG. 1 illustrates detachable table 11 mounted on portable logsplitter 10 for storing logs to split or for receiving the split portions of a log. The log splitting mechanism includes frame 12, preferably a horizontal I-beam, coupled to hydraulic ram 13 by back plate 15. The piston in ram 13 is coupled to wedge 17, which rests on slide 19. Slide 19 is free to move longitudinally along frame 12. Stop plate 21 is attached to one end of frame 12 and supports log 23 during splitting. The log splitting mechanism is carried by trailer 25 which includes a suitable power source 27 for operating hydraulic ram 13.

Table 11 is coupled to frame 12 by catches 32 and 33 and is supported vertically by collapsible leg 35. FIG. 2 is an end view, in partial cross-section, of table 11 and the attachment mechanism. Table 11 includes platform 30, located in a horizontal plane by clamp 31 and located vertically by leg 35. Clamp 31 includes catch 32 (FIG. 1), catch 33, and hook 37. Catch 33 and hook 37 grasp opposite sides of frame 12 to hold platform 30 in place. Hook 37 is coupled to platform 30 by strap 39. Strap 39 is preferably a woven plastic strap including an adjustable clasp for permitting the strap to be shortened or lengthened to accommodate frames of different sizes. Leg 35 is connected to platform 30 by pivot 41, enabling leg 35 to be swung up against the platform for storage. Leg 35 preferably includes two telescoping sections fastened by latch 43 to vary the length of the leg and to accommodate uneven terrain.

Catch 33 is a metal strip attached to platform 30 and including bend 38 to separate a portion of the strip from platform 30. The lower flange of frame 12 fits between the free end of catch 33 and platform 30. Catch 33 and hook 37 overlap the lower flange of frame 12 to provide a secure hold and to permit a slight movement of platform 30 without disengaging from frame 12. Strap 39 is preferably slightly resilient, which prevents undue tension on the strap if platform 30 is pulled away from frame 12.

As illustrated in FIG. 3, catches 32 and 33 are preferably located near the ends of a long side of platform 30. Strap 39 and hook 37 are preferably located approximately centrally along the long side of platform 30. This arrangement provides a secure attachment to frame 12 and minimizes any motion of platform 30. Strap 39 permits platform 30 to be readily disconnected from frame 12 and cutout 45 provides a built-in handle for platform 30 to facilitate transportation thereof.

FIGS. 4 and 5 illustrate an alternative embodiment of a clamp mechanism. In this embodiment, platform 30 acts as a portion of the clamp, specifically as the catch. Hook members 51 and 52 are attached to the underside of platform 30 and engage the opposite side of frame 12 from platform 30. Hook member 52 is attached to platform 30 by bolts 53 and 54 and by nuts 56 and 57. Nuts 56 and 57 are preferably wing nuts to facilitate attaching and removing platform 30.

As illustrated in FIG. 6, hook member 53 includes offset 59 to separate a portion of the member from platform 30 and positioning the edge of platform 30 above the lower flange of frame 12 (FIG. 5). Hook member 53 includes elongated slot 63 for adjusting the platform to frames of different widths.

The invention thus provides a rugged table that can be attached securely to commercially available log splitters and easily removed for transporting the log splitter from site to site. Having thus described the invention, it will be apparent to those of skill in the art that various modifications can be made within the scope of the invention.

What is claimed as the invention is:

1. A log splitter comprising:

an elongated frame having a first end and a second end;

a stop attached to said frame near said first end;

a wedge mounted on said frame and adapted to be moved along said frame between said stop and said second end;

a detachable table including a platform, a clamp for attaching said platform to said frame, and an adjustable leg pivotally attached to the underside of said platform.

2. The log splitter as set forth in claim 1 wherein said platform is approximately rectangular and has a long side adjacent said frame and wherein said clamp comprises:

at least one catch attached to said platform for engaging one side of said frame;

a hook for engaging the opposite side of said frame;

a strap for attaching said hook to said platform, said strap being adjustable in length.

3. The log splitter as set forth in claim 2 wherein said clamp includes a pair of catches located near opposite ends of said long side and wherein said strap is attached to said platform approximately centrally along said long side.

4. The log splitter as set forth in claim 1 wherein said platform includes an aperture near one side thereof, said aperture providing a handle for grasping the table.

5. The log splitter as set forth in claim 1 wherein said frame is an I-beam and said clamp engages the lower flange of said I-beam.

* * * * *